US005626730A

United States Patent [19]

Shimamune et al.

[11] Patent Number: 5,626,730

[45] Date of Patent: May 6, 1997

[54] ELECTRODE STRUCTURE

[75] Inventors: Takayuki Shimamune; Yasuo Nakajima, both of Tokyo; Yoshiaki Suganuma, Kanagawa, all of Japan

[73] Assignee: Permelec Electrode Ltd., Kanagawa, Japan

[21] Appl. No.: 442,768

[22] Filed: May 17, 1995

[30] Foreign Application Priority Data

May 24, 1994 [JP] Japan ..... 6-109710

[51] Int. Cl.[6] ..... C25D 17/12

[52] U.S. Cl. ..... 204/290 R; 204/290 F; 204/280

[58] Field of Search ..... 204/280, 286, 204/284, 290 R, 290 F

[56] References Cited

U.S. PATENT DOCUMENTS

| | | | |
|---|---|---|---|
| 4,318,794 | 3/1982 | Adler | 204/216 |
| 4,936,971 | 6/1990 | Pohto | 204/286 |
| 5,089,109 | 2/1992 | Suganuma et al. | 204/290 R |

FOREIGN PATENT DOCUMENTS

| | | |
|---|---|---|
| 0407355 | 1/1991 | European Pat. Off. . |
| 0424807 | 5/1991 | European Pat. Off. . |
| 0504939 | 9/1992 | European Pat. Off. . |

OTHER PUBLICATIONS

Derwent Abstract of JP–A 5–202498 no date available.
Derwent Abstract of JP–A 5–171486 no date available.
Derwent Abstract of JP–A 5–148687 no date available

*Primary Examiner*—Kathryn L. Gorgos
*Attorney, Agent, or Firm*—Sughrue, Mion, Zinn, Macpeak & Seas

[57] ABSTRACT

An electrode structure containing an insoluble metal electrode which is used as an electrode for the electrolysis of an acidic aqueous solution under a high current density is disclosed. An elastic electroconductive material, containing an expanded metal, having formed thereon a corrosion-resistant electroconductive coating, is disposed between an electroconductive electrode substrate and an electrode having on the surface thereof a coating of an electrode material. They are fixed by a detachable fixing device from the surface of the electrode. The electrode can be exchanged when fixing the electrode structure to the electrolytic cell.

12 Claims, 1 Drawing Sheet

ELECTRODE STRUCTURE

FIELD OF THE INVENTION

The present invention relates to an electrode for electrolysis, and more particularly to an electrode structure comprising an insoluble metal electrode used for the electrolysis of an acidic aqueous solution under a high current density.

BACKGROUND OF THE INVENTION

In the electrolysis of an acidic aqueous solution, such as an electrolytic collection of a metal, electroplating, etc., a lead electrode was mainly used as the anode. Recently, in place of the lead electrode, an insoluble metal electrode, prepared by coating an electrode material solution containing a platinum group metal on the surface of a corrosion resistant valve metal, such as titanium, etc., and thermally decomposing the resulting coating in an oxidizing atmosphere at a temperature of from 400° C. to 600° C. to form an oxide coating, has been used. The utilization of such an insoluble metal electrode as an electrolytic electrode in a large-scale high-current density application, such as for high-speed zinc plating, copper foil production, etc., has recently increased because of the durability, the dimensional stability, and the ease with which the insoluble metal electrode can be shaped.

For example, in high-speed zinc plating, a large electrode having one anode area of about 2 $m^2$ is sometimes used, and when the maximum current density is 20 $kA/m^2$, an electric current of about 40 kA is passed through one anode. Also, in the anode for producing electrolytic copper foils, one anode area is about 4 $m^2$ and the electric current sometimes is about 30 kA. Also, in electrolysis, a non-uniform electric current distribution causes products to have extremely poor quality, such that it has particularly been required to make the electric current distribution uniform.

Thus, even where a metal having a good electroconductivity, such as titanium, is used as the electrode substrate in order to pass a large electric current, it is necessary to ensure that the thickness of the electrode substrate is 10 mm or more, and, as the case may be, an electrode substrate having a thickness of 40 mm or more is used.

On the other hand, coating an electrode material on the electrode substrate is generally carried out by thermally decomposing the coating of the electrode material contained in a liquid. Also, in the case of an electrode substrate having a large thickness for passing a large electric current, from 30 minutes to one hour is required to raise the temperature to the thermal decomposition temperature of from 450° C. to 600° C., and after carrying out the thermal decomposition for 10 to 15 minutes, a time of at least 2 hours is required for maintaining the temperature and allowing it to cool. Furthermore, for obtaining a desired coating thickness on the electrode material, the coating and thermal decomposition operation described above is carried out repeatedly from 10 to several tens of times, and sometimes coating the electrode material may take one to two weeks or longer.

To overcome these problems, it has been proposed to use an electrode structure wherein the electrode substrate for supplying the current to the electrode and for supporting the electrode and the electrode portion of forming the coated layer of the electrode material are separately prepared and the electrode is fixed to the electrode substrate by screws or stud bolts which are fixed to the electrode.

However, even in this method, since it is required to form screws in the electrode or to form other connecting means thereto, the thickness of the electrode is required to be from about 3 to 10 mm.

Only the method of heating such an electrode is far easier when compared with the conventional method of carrying out the heat treatment of the entire electrode structure, but it is not capable of shortening the heating and cooling times. Also, since various fixing means for fixing the electrode substrate are formed on the electrode plate, the area around the fixing means has a slightly different thermal environment from that of other portions, and as a result, a problem results in that the characteristics of the electrode are changed. Moreover, since in the conventional electrode structure, fixing the electrode to the electrode substrate is carried out at the back surface of the electrode, it is difficult to exchange the electrode when the electrode is fixed to the electrolytic apparatus.

Thus, the inventors previously proposed a method of fixing a thin electrode to the surface of an electrode plate by welding Or screws in JP-A-5-171486 and JP-A-5-202498 (the term "JP-A" as used herein means an "unexamined published Japanese patent application").

By this method, the electrode can be exchanged when fixing the electrode structure to the electrolytic cell, and it becomes easy to form the electrode Coating, and as a result, the method can be used without any problems until the current density is about 100 $A/m^2$. However, since the supply of the electric current from the electrode substrate to the electrode plate is only carried out at the fixed screw portion or the welded portion, the electric current is concentrated at these portions. Thus, for passing an electric current having a large current density, it is required to mainly increase the number of the fixed portions or to increase the thickness of the electrode.

SUMMARY OF THE INVENTION

Accordingly, an object of the present invention is to provide an electrode structure comprising an insoluble metallic electrode in which an electrode used as an anode for collecting a metal or metal plating at a large current density and the electrode are separately produced, wherein the electrode is easily fixed to the electrode substrate and an electric current can be uniformly supplied to the entire surface of the electrode.

That is, according to a first embodiment of the present invention, there is provided an electrode structure comprising an electroconductive electrode substrate having fixed to the surface thereof an electrode coated with an electrode material, wherein an elastic electroconductive material is placed between the electrode substrate and the electrode and they are fixed by a detachable fixing means from the surface of the electrode.

According to a second embodiment of the present invention, there is provided the electrode structure of the first embodiment, wherein the elastic electroconductive material is an expanded metal.

According to a third embodiment of the present invention, there is provided the electrode structure of the first embodiment, wherein on the surface of the elastic electroconductive material there is formed an electroconductive coating which is corrosion-resistant in an electrolytic environment.

According to a fourth embodiment of the present invention, there is provided the electrode structure of the first embodiment, wherein on at least the surface of the electroconductive electrode substrate there is formed a corrosion-resistant coating which is composed of titanium or a titanium alloy which is electroconductive.

According to a fifth embodiment of the present invention, there is provided the electrode structure of the first embodiment, wherein the electrode is titanium or a titanium alloy having coated on the surface thereof an electrode material containing iridium oxide which can be used as an anode in an acidic aqueous solution.

DETAILED DESCRIPTION OF THE PRESENT INVENTION

The present invention is explained in detail by referring to the accompanying drawings.

Figure 1:
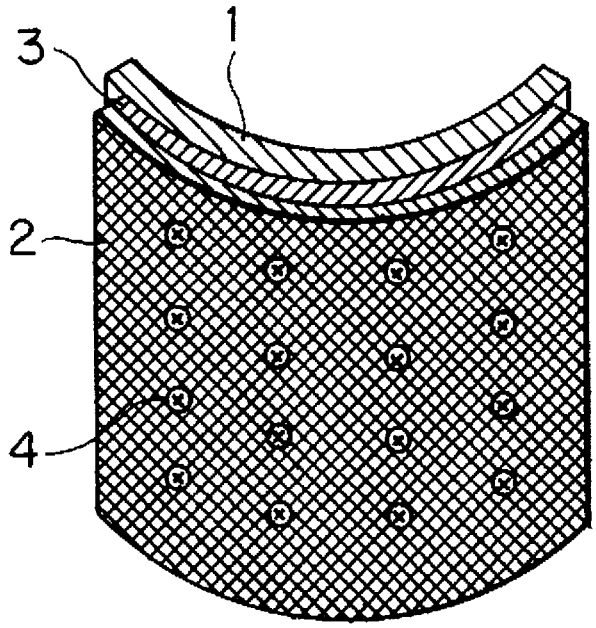
FIG. 1 is a perspective view showing one embodiment of the electrode structure of the present invention, and FIGS. 2 (A) and (B) are cross sectional views each showing the fixed portion of the electrode structure of the present invention.

FIG. 1 is a perspective view showing one embodiment of the electrode structure of the present invention.

At least the surface of the electrode substrate 1 is formed by a corrosion-resistant metal such as titanium, tantalum, or an alloy thereof, and it is preferred that the surface of the electrode substrate 1 is formed by an electroconductive corrosion-resistant coating. The electroconductive corrosion-resistant coating may be formed by heating the electrode substrate to a temperature of from 500° C. to 650° C. for from 1 to 3 hours in air to form the oxide on the surface thereof, or may be formed by coating a solution containing a salt of titanium or tantalum on the surface of the substrate and heating the resulting coating in air at a temperature of from 400° C. to 600° C. to oxidatively decompose the coated layer, whereby a protective layer is formed. Furthermore, by adding a compound of a platinum group metal such as platinum, ruthenium, etc., to titanium or tantalum, the electro-conductivity and the corrosion resistance of the coating can be increased.

An electrode 2 comprises an electroconductive substrate comprising a corrosion resistant metal such as a thin layer-forming metal (e.g., titanium and tantalum) or the alloys thereof, etc., coated with an electrode material. The electroconductive substrate comprises a metal plate, a porous metal plate, an expanded metal, etc., and for fixing the electroconductive substrate to the electrode substrate 1 while keeping the plane accuracy of the electrodes (i.e., the accuracy in the distance between electrodes because of surface unevenness or curved surface), it is preferred that the electrode substrate is flexible to some extent and that the thickness thereof is preferably from about 0.5 mm to 2 mm.

As the electrode material which forms the coating on the electrode, it is preferred to coat a solution containing the salt of a platinum group metal on the electroconductive substrate and thermally decompose the coated layer in air to form the oxide of the metal thereon. Although varying according to the material to be electrolyzed or the composition of the electrolyte, the electrode having a coating formed by coating a coating liquid prepared by dissolving iridium chloride and tantalum chloride in butyl alcohol such that the ratio of iridium chloride/tantalum chloride becomes 70/30 mol % followed by thermal decomposition is preferable as an anode for generating oxygen in an acidic electrolyte.

An elastic electroconductive material 3 is disposed between the electrode substrate 1 and the electrode 2 and is preferably an expanded metal, a plate spring, etc. Also, the electroconductive material 3 preferably has an elasticity capable of remaining balanced under pressure while clamping the screws at the time of fixing the electrode by the screws, etc., and in particular, an expanded metal having a thickness of from 0.2 mm to 0.5 mm which is expanded only and preferably one which is not subjected to a flattening treatment by rolling.

The preferred materials for the electroconductive material having elasticity are titanium, tantalum, and the alloys thereof. The surface of the electroconductive material having elasticity may be heat-treated in an oxygen-containing atmosphere to form an electroconductive protective layer comprising an oxide, or a solution containing a salt of titanium, tantalum, etc., may be coated on the surface of the electroconductive material and heat-treated in an oxygen-containing atmosphere at a temperature of from 400° C. to 600° C. to form an electroconductive protective layer comprising the metal oxide, or further by adding a platinum group metal such as platinum, ruthenium, etc., to a solution containing the salt of titanium, tantalum, etc., and coating the solution on the electroconductive material followed by heat treatment to form an electroconductive protective layer containing a metal such as platinum, etc., or an electroconductive metal oxide such as ruthenium oxide, etc.

The thickness of the electroconductive protective layer formed on the surface of the electroconductive material is preferably from 0.1 mm to 0.5 mm.

It is preferred that bonding the electrode 2 and the electroconductive material 3 to the electrode substrate 1 be carried out with a screw 4 by forming a proper distance between the screws. In this case, it is preferred to properly control the distance between the screws by the thickness of the electrode or the form such as the curvature, etc., of the electrode such that the electrode can maintain a desired electrode surface without causing a partial rise of the electrode. Also, for fixing these members, it is preferred to use a screw having a flat head called a countersunk screw, a flat screw, etc., and as the material for the screw, titanium, tantalum, and the alloys thereof are preferable. It is also preferred that the surface of the screw is coated with the same electroconductive protective layer or electrode material as formed on the electroconductive material.

Figure 2A:
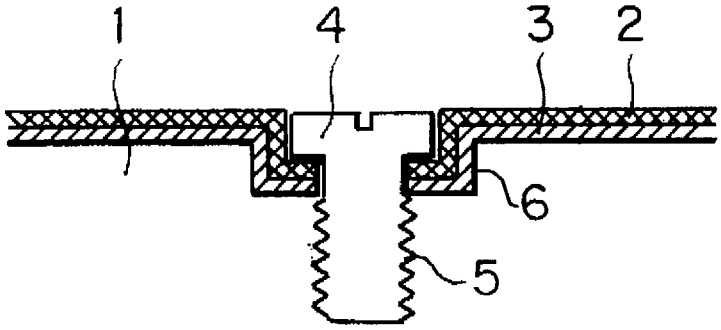
Figure 2B:
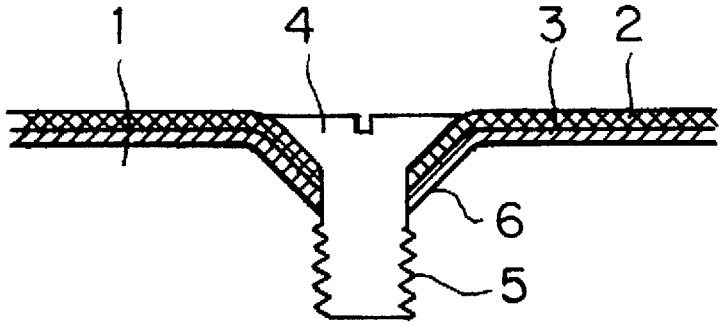

FIGS. 2 (A) and (B) are cross sectional views explaining the fixed portions and each shows the embodiment of a different form of a fixing screw.

As shown in FIG. 2, in the electrode substrate 1, there is formed a screw hole 5, and also in the electrode substrate 1, there is formed a concave portion 6 such that the head of the screw is completely in the same plane as the surface of the electrode or is positioned slightly lower than the surface of the electrode when fixing the electrode 2 and the electroconductive material 3 to the electrode substrate 1. In this case, it is preferred that the fixing means does not project above the surface of the electrode.

The concave portions formed in the electrode 2 and the electroconductive material 3 can be formed by press working, etc., in the case of processing the electrode and the substrate for the electroconductive material. Also, in the concave portions, a cut, etc., may be formed to increase the electroconductive connection of the electrode substrate 1, the electroconductive material 3, the electrode 2, and the screw 4 to each other.

In the electrode structure of the present invention, since the electrode 2 is fixed to the electrode substrate 1 via the electroconductive material 3 having elasticity and the electrode 2 is fixed by a detachable fixing means 4 at the electrolytic action surface side of the electrode, the electrode can be exchanged when fixing the electrode structure to the electrolytic cell, a large-sized electrode can be easily produced and an electrode structure having excellent dimensional accuracy is obtained. Furthermore, since the electroconductive material having elasticity is disposed between the electrode substrate and the electrode in fixing them, an electrode structure having a low electric resistance, a uniform electric current distribution over the entire electrode surface, a low electrolytic voltage, and a long life is obtained.

The present invention is described in more detail by reference to the following examples, but it should be understood that the invention is not construed as being limited thereto. Unless otherwise indicated herein, all parts, percents, ratios and the like are by weight.

EXAMPLE 1

In a titanium plate having a length of 300 mm, a width of 300 mm, and a thickness of 10 mm, there were formed 10 screw holes each having a countersunk form having a depth of 10 mm, a diameter of the upper portion of 21 mm, and an angle of 90° at the same distance as shown in FIG. 2 (A) for fixing countersunk screws of a nominal count of M8.

After forming concave portions and holes in a titanium plate having a thickness of 1 mm for fixing it by screws, the titanium plate was heated in air at 530° C. to form an oxide layer, a coating liquid prepared by dissolving iridium chloride and tantalum chloride in butyl alcohol such that the ratio of iridium oxide/tantalum oxide in the oxides formed became 70/30 mol % was coated on both the surfaces of the titanium plate, and the coated plate was heated in air at 530° C. for 10 minutes to cause thermal decomposition. In this case, the above treatment was applied only once to the electrode substrate side of the electrode plate and the treatment from coating to thermal decomposition was repeatedly applied to the electrolytic action surface side 12 times.

An aqueous hydrochloric acid solution of tantalum chloride was coated on the surface of the electrode substrate and the surface of an expanded metal having a thickness of 0.2 mm, a long diameter (LW) of an opening of 10 mm, a short diameter (SW) of an opening of 5 mm, and a strand of 1 mm and they were burned in air at 550° C. for 10 minutes to form each electroconductive protective layer composed of a titanium-tantalum mixed oxide.

Also, a coated layer of the electrode material was formed on the surfaces of the countersunk screws in the same manner as in the case when forming the electrode plate described above; the expanded metal having formed on the surface thereof the oxide layer was disposed between the electrode substrate and the electrode and they were fixed by the countersunk screws.

Onto the surface of the resulting electrode, there was pressed an expanded metal having a thickness of 0.2 mm made by silver, an electric current was passed between the electrode substrate and the silver-made expanded metal, and the ohm loss at the electrode fixed portions was measured.

When an electric current of 1,000 A corresponding to a current density of 110 A/dm$^2$ was passed through the electrode surface, the ohm loss at each fixed portion was from 2 to 4 mV.

On the other hand, when the electroconductive member having elasticity was not disposed between the electrode substrate and the electrode, the electric current was considered to be concentrated at the screw portions of the fixed portions, the ohm loss at the fixed portions was from 15 to 20 mV, and heat generation occurred at the screw portions.

EXAMPLE 2

An electrode was prepared in the same manner as in Example 1 except that a net formed by a titanium wire having a diameter of 0.3 mm was used in place of the electroconductive member. When the ohm loss was measured in the same manner as in Example 1, the ohm loss was 3 mV.

Since in the electrode structure of the present invention, a large-sized insoluble metal electrode is used to meet the large-size of the continuous iron and steel surface treatment line, the copper foil production, etc., or to meet a high current density, the electrode is detachably fixed to the electrode substrate, and the electroconductive member having elasticity is disposed between the electrode substrate and the electrode, the electroconductive connection between the electrode substrate and the electrode is good, the electric current is not maldistributed, the loss of voltage is small when passing a large electric current, and only the electrode can be exchanged when fixing the electrode structure to the electrolytic cell.

While the invention has been described in detail and with reference to specific embodiments thereof, it will be apparent to one skilled in the art that various changes and modifications can be made therein without departing from the spirit and scope thereof.

What is claimed is:

1. An electrode structure comprising an electrode substrate, an elastic electrically conductive material, and an electrode which is coated with an electrode material, wherein said elastic electroconductive material is directly disposed between the electrode substrate and the electrode over the entire surfaces thereof and wherein the electrode substrate and the electrode are fixed by a detachable fixing means from the surface of the electrode.

2. The electrode structure of claim 1, wherein the elastic electroconductive material is an expanded metal.

3. The electrode structure of claim 2, wherein the expanded metal has a thickness of from 0.2 mm to 0.5 mm.

4. The electrode structure of claim 1, wherein an electroconductive coating which is corrosion-resistant in an electrolytic environment is formed on a surface of the elastic electroconductive material.

5. The electrode structure of claim 1, wherein at least a surface of the electrode substrate comprises at least one metal selected from the group consisting of titanium, a titanium alloy, tantalum, and a tantalum alloy.

6. The electrode structure of claim 1, wherein an electroconductive coating comprising at least one corrosion-resistant metal selected from the group consisting of titanium, a titanium alloy, tantalum, a tantalum alloy, a platinum group metal and an alloy of a platinum group metal is formed on the surface of the electrode substrate.

7. The electrode structure of claim 1, wherein the electrode substrate has a thickness of from 0.5 mm to 2 mm.

8. The electrode structure of claim 1, wherein the electrode comprises an electroconductive substrate comprising a corrosion-resistant metal selected from the group consisting of titanium, a titanium alloy, tantalum and a tantalum alloy.

9. The electrode structure of claim 1, wherein the electrode material coated on the electrode comprises at least one platinum group metal.

10. The electrode structure of claim 1, wherein the elastic electroconductive material comprises at least one metal selected from the group consisting of titanium, a titanium alloy, tantalum and a tantalum alloy.

11. The electrode structure of claim 1, wherein the detachable fixing means comprises at least one metal selected from the group consisting of titanium, a titanium alloy, tantalum and a tantalum alloy.

12. The electrode structure of claim 1, wherein the detachable fixing means are evenly spaced on the surface of the electrode.

* * * * *